US006565023B2

(12) United States Patent
Schmitt

(10) Patent No.: US 6,565,023 B2
(45) Date of Patent: May 20, 2003

(54) APPARATUS FOR COMMINUTING, GRINDING AND DISPERSING FLOWABLE GRINDING STOCK

(75) Inventor: Philipp Schmitt, Lampertheim (DE)

(73) Assignee: Draiswerke GmbH, Mannheim (DE)

( * ) Notice: Subject to any disclaimer, the term of this patent is extended or adjusted under 35 U.S.C. 154(b) by 121 days.

(21) Appl. No.: 09/817,114

(22) Filed: Mar. 27, 2001

(65) Prior Publication Data

US 2001/0028006 A1 Oct. 11, 2001

(30) Foreign Application Priority Data

Mar. 28, 2000 (DE) ..... 100 15 375

(51) Int. Cl.[7] ..... B02C 15/16

(52) U.S. Cl. ..... 241/36; 241/252; 241/258; 241/259.1; 241/261.1

(58) Field of Search ..... 241/198.1, 199.5, 241/199.6, 199.7, 259.1, 261.1, 252, 257.1, 258, 117, 253, 36

(56) References Cited

U.S. PATENT DOCUMENTS

| | | | |
|---|---|---|---|
| 2,361,121 A | 10/1944 | Poupin | |
| 4,067,503 A | 1/1978 | Broman | |
| 4,807,818 A | 2/1989 | Standring | |

FOREIGN PATENT DOCUMENTS

| | | |
|---|---|---|
| DE | 345 916 C | 12/1921 |
| DE | 721 901 C | 6/1942 |
| DE | 8 80 245 C | 6/1953 |
| DE | 1 008 563 B | 5/1957 |
| DE | 36 02 932 A1 | 8/1987 |
| EP | 0 126 437 | 5/1984 |
| EP | 0 153 754 A2 | 2/1985 |

*Primary Examiner*—Mark Rosenbaum
(74) *Attorney, Agent, or Firm*—Browdy and Neimark P.L.L.C.

(57) ABSTRACT

An apparatus for comminuting, grinding and dispersing flowable grinding stock has a grinding receptacle with an inner, first grinding surface, which is rotationally symmetrical relative to an axis of rotation, and is drivable to rotate about the axis of rotation. Also provided is a grinding roller, which has a second grinding surface that is rotationally symmetrical relative to a central longitudinal axis, and is drivable to rotate about the axis. A grinding gap is defined between the first grinding surface and the second grinding surface.

19 Claims, 2 Drawing Sheets

FIG. 2
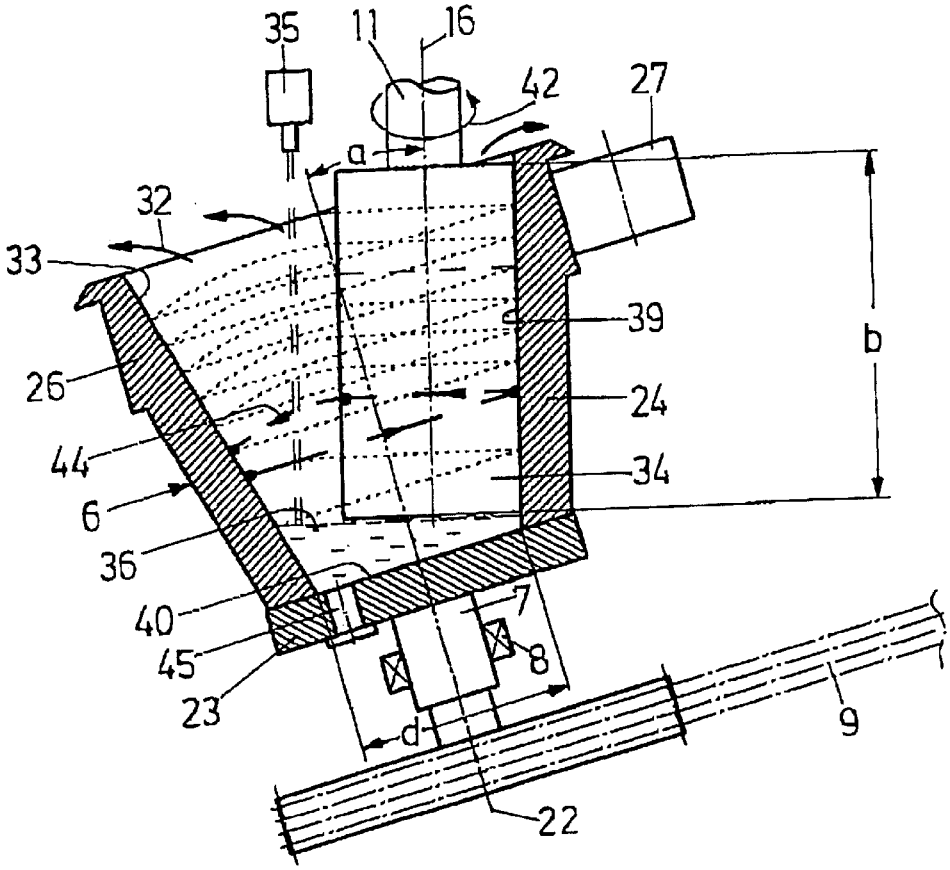
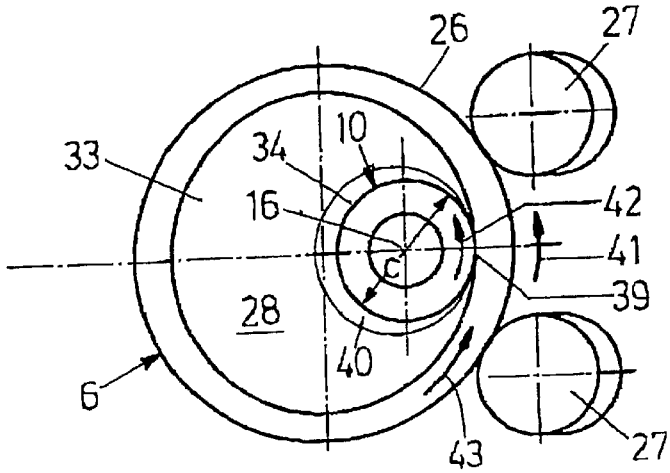
FIG. 3

APPARATUS FOR COMMINUTING, GRINDING AND DISPERSING FLOWABLE GRINDING STOCK

BACKGROUND OF THE INVENTION

1. Field of the Invention

The invention relates to an apparatus for comminuting, grinding and dispersing flowable grinding stock.

2. Background Art

Apparatuses of the generic type are known in many forms as so-called agitator mils. These agitator mills have a grinding receptacle that defines a grinding chamber, in which a rotor and auxiliary grinding bodies are disposed. The grinding stock passes through the grinding chamber, and is essentially comminuted, ground and dispersed by the movement of the auxiliary grinding bodies.

These apparatuses are also known as so-called roller mills; in these machines, two or more rollers form a grinding gap, which can be adjusted between two rollers. In the grinding gap, the grinding stock is subjected to high shearing stresses, and is thereby comminuted, ground and dispersed. Roller mills of this type are used in the production of printing inks, among other things. A drawback of these machines is that the grinding stock must be collected after each passage through the roller mill, and supplied to it again.

SUMMARY OF THE INVENTION

It is an object of the invention to create an apparatus of the generic type, in which the grinding stock can be repeatedly subjected to shearing actions by structurally simple means, In accordance with the invention, his object is accomplished in an apparatus for comminuting, grinding and dispersing flowable grinding stock, comprising

- a stand;
- a grinding receptacle,
  - which is rotatably seated on the stand,
  - which has an axis of rotation,
  - which has an interior that is prodded with an opening that is open toward the top,
  - which is drivable to rotate about the axis of rotation, and
  - which has an inner, first grinding surface,
    - which is rotationally symmetrical relative to the axis of rotation, and
    - defines the interior of the grinding receptacle;
- a grinding stock feed line for the supply of grinding stock the opening;
- a grinding stock discharge, which discharges from the opening;
- a grinding roller,
  - which is rotatably seated on the stand,
  - which has a central longitudinal axis,
  - which is drivable to rotate about the central longitudinal axis, and
  - which has a second grinding surface,
    - which is rotationally symmetrical relative to the central longitudinal axis, and
    - which cooperates with the first grinding surface to define a grinding gap.

The crux of the invention is the configuration of the apparatus such that the material to be ground is supplied to the grinding gap multiple times in one passage, because the rotational forces at the first grinding surface cause the material to move along approximately helical paths to the material discharge. The basic action of the apparatus according to the invention can best be compared to that of a roller null having a hollow roller, inside which an inner roller is disposed, forming a grinding gap. In this regard, the grinding receptacle could also be characterized as a hollow roller. Unlike agitator mills, the apparatus according to the invention operates without auxiliary grinding bodies.

Further features, advantages and details of the invention ensue from the following description of an exemplary embodiment illustrated in the drawing.

BRIEF DESCRIPTION OF THE DRAWING

FIG. 2 is a vertical longitudinal section through the grinding receptacle and the grinding roller of the apparatus of FIG. 1, in a schematic representation for explaining the function;

FIG. 3 is a plan view of FIG. 2.

DESCRIPTION OF THE PREFERRED EMBODIMENT

Figure 1:
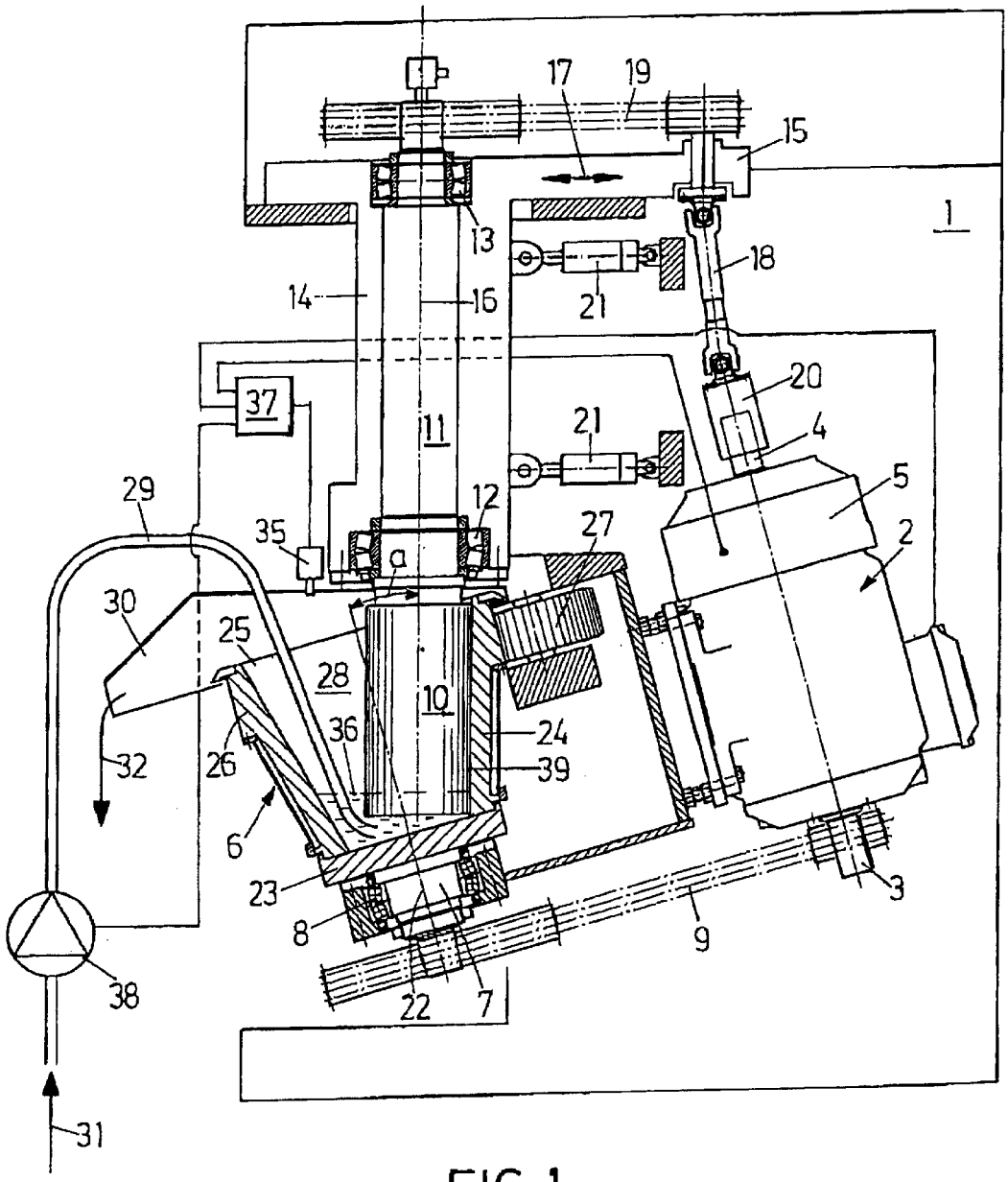
FIG. 1 is a vertical longitudinal section through an apparatus according to the invention.

As can be inferred from FIG. 1, an apparatus according to the invention has a stand 1, in which an electric drive motor 2 is seated. The motor has a lower, first power take-off 3 and an upper, second power take-off 4, which is driven by the motor 2, by way of a gear 5 having an infinitely-variably-adjustable transmission. A grinding receptacle 6 is rotatably seated on the stand 1 by means of a lower bearing journal 7 in bearings 8. The first power take-off 3 employs a belt drive 9 in driving the receptacle to rotate.

A grinding roller 10, which is mounted to a roller drive shaft 11, is disposed in the grinding receptacle 6. The drive shaft 11 is extremely sturdy, and is seated in two bearings 12, 13, which are spaced as far apart as possible in a bearing slide element 14. In the upper region of the stand 1, the bearing slide element 14 is seated in a guide 15 so as to be displaced with the grinding roller 10 in the direction 17, which extends transversely to the essentially vertical, central longitudinal axis 16 of the drive shaft 11. The drive shaft 11, and therefore the grinding roller 10, can be driven by the second power take-off 4 of the motor 2 by way of an articulated shaft 18 and a belt drive 19, with the articulated shaft 18 being coupled to the second power take-off 4 by way of a sliding bearing 20, so displacements of the bearing slide element 14 in the direction 17 can be compensated. The bearing slide element 14 can be moved into a desired position by hydraulically-actuatable adjusting drives 21, e.g., in the form of hydraulically-actuatable piston-cylinder drives, then secured or blocked in this position.

The adjusting drives 21 are articulated to the stand 1. They can also be actuated individually for reasons that will be explained below.

The grinding receptacle 6 is approximately frustoconical, and is embodied to be rotationally symmetrical relative to an axis of rotation 22 extending through the bearing journal 7. The receptacle has a bottom 23 and a frustoconical receptacle wall 24, which widens toward the top. The grinding receptacle 6 has an upper opening 25; near this opening, on the outside of the receptacle wall 24, is an annular, preferably cylindrical-ring-shaped, support surface 26, against which support rollers 27 rest, the rollers being supported in turn in the stand 1.

A grinding stock supply line 29 leads into the interior 28 of the grinding receptacle 6, namely in the open region between the bottom 23 and the grinding roller 10. Provided in the region of the opening 25 is a grinding stock discharge 30, the discharge surrounding the opening 25. The material to be ground is guided through the line 29 in the supply direction 31, and is carried off in the discharge direction 32.

The inside surface of the receptacle wall 24 forms a polished, frustoconical, first grinding surface 33. The surface of the grinding roller 10 also forms a polished, cylindrical, second grinding surface 34.

The axis of rotation 22 of the grinding receptacle 6 and the axis 16 of the grinding roller 10 form an angle a, which corresponds, entirely or at least essentially, to one-half of the opening angle of the frustoconical first grinding surface 33. The two grinding surfaces 33 and 34 can also be slightly convex.

Also provided on the stand 1 is a sensor 35, which can be used to detect the fullness level 36 of the material in the grinding receptacle 6. The signals of this sensor 35 are transmitted to a central control 37, which influences the drive motor 2, the gear 5, and thus the speeds of the grinding receptacle 6 and the grinding roller 10. This central control 37 also actuates a grinding stock pump 38. The control 37 is freely programmable.

The apparatus functions as follows.

The first grinding surface 33 and the second grinding surface 34 define a grinding gap 39, which extends essentially parallel to the axis 16, as can be seen in FIGS. 1 and 2. The overlap of the first grinding surface 33 and the second grinding surface 34 in the direction of the axis 16, that is, the length b of the grinding gap 39, extends essentially from the bottom 23 to the opening 25 of the grinding receptacle 6. The diameter c of the grinding roller 10 is always smaller than the projection of the diameter d of the inside bottom surface 40 onto the diameter c. The following applies: $c<d\times\cos a$. The following preferably applies:

$$0.2d\times\cos a\leqq c\leqq 0.9\times\cos a.$$

The adjusting drives 21 have moved the bearing slide element 14, with the drive shaft 11 and the grinding roller 10, into a position in which the grinding gap 39 has a desired width and, if applicable, a desired extension, The grinding receptacle 6 is driven in the direction of rotation 41, and the grinding roller 10 is driven in the direction of rotation 42—in other words, as can be seen in FIG. 3, in the same direction—so the material is conveyed through the grinding gap 39 in the same conveying direction 43. As can be seen from FIGS. 1 and 2, the fullness level 36 of the grinding stork is very low, so the grinding roller 10 only dips slightly into the material. When the grinding receptacle 6 and the grinding roller 10 are inoperative, therefore, the majority of the grinding gap 39 is located above the fullness level 36 of the material. Upon rotary actuation, the frustoconical widening of the first grinding source 33 toward the opening 25 located at the top causes the grinding stock to be conveyed upward on helical paths 44; consequently, the material passes through the grinding gap 39 multiple times until it reaches the opening 25, and thus the discharge 30. For cleaning purposes, a closable outlet 45 is provided in the bottom 23.

Because of the at least essentially frustoconical embodiment of the first grinding surface 33 and the at least essentially cylindrical embodiment of the second grinding surface 34, relative speeds exist in the grinding gap 39 between the grinding surfaces 33 and 34; in theory, identical circumferential speeds of the grinding surfaces 33 and 34 can dominate at a single location. This is the case when $a>0$, that is, when the first grinding surface 33 is actually frustoconical and the second grinding surface 34 is cylindrical. In general, $0<a\leqq 45°$. Preferably, $10°\leqq a\leqq 30°$. If the first grinding surface 33 is also cylindrical, that is, $a=0$, which is entirely possible, the above-described conveying actions still take place, i.e., the grinding stock moves upward toward the opening 25 in an approximately helical movement, relative to the first grinding surface 33. Generally, the relative speeds can be significantly influenced if the grinding receptacle 6 and the grinding roller 10 are driven at different, variable rpms.

The angle a can be modifiable such that the width of the grinding gap 39 changes over its length b. For example, the arrangement can be such that the grinding gap 39 has its greatest width downwards, i.e., where it begins in the vicinity of the bottom 23, and the width continuously decreases toward the top. This can be achieved in that the grinding receptacle 6 is seated to pivot by a small angle in the region of its bearing 8. In particular, this can be achieved simply by actuating the adjusting drives 21 slightly differently, which effects a corresponding change in the width of the grinding gap 39 over its length b. Because such changes in the width of the grinding gap 39 over its length b lie within a range of thousandths of millimeters, this can be achieved by the corresponding different actuation of the adjusting drives 21 based on the unavoidable play present in the guide 15. In addition, changes in the width of the grinding gap 39 with a frustoconical embodiment of the first grinding surface 33 can also be effected by the relative displacement of the grinding receptacle 6 and the grinding roller 10 in the direction of the axis 16. The width of the grinding gap 39 lies in a range of 3 to 500 $\mu$m preferably in a range of 5 to 50 $\mu$m.

What is claimed is:

1. An apparatus for comminuting, grinding and dispersing pumpable grinding stock, comprising:

a stand (1);

a grinding receptacle (6), which is rotatably seated on the stand (1), which has a bottom (23);

which has an axis of rotation (22), which has an interior (28) that is provided with an opening (25) that is open toward the top, which is drivable by an electric drive motor (2) to rotate about the axis of rotation (22), and which has an inner, first grinding surface (33), which is rotationally symmetrical relative to the axis of rotation (22), and which defines the interior (28) of the grinding receptacle (6);

a grinding roller (10), which is rotatably seated on the stand (1), which has a central longitudinal axis (16), which is drivable to rotate about the central longitudinal axis (16), and which has a second grinding surface (34), which is rotationally symmetrical relative to the central longitudinal axis (16), and which cooperates with the first grinding surface (33) to define a grinding gap (39) that has a width;

a grinding stock feed line (29) with a grinding stock pump (38) for the supply of pumpable grinding stock through the opening (25) into an open region between the bottom (23) and the grinding roller (10) to a fullness level (36) whereby the fullness level (36) is such that a majority of the grinding gap (39) is located above the fullness level (36) when the grinding receptacle (6) and the grinding roller (10) are inoperative;

a grinding stock discharge (30), which discharges from the opening (25);

a central control unit (37) for the electric drive motor (2); and a sensor (35) for detecting the fullness level (36) of the grinding stock in the grinding receptacle (6) and for transmitting fullness level signals to the control unit (37) to vary a speed of at least one of the grinding receptacle (6) and the grinding roller (10).

2. The apparatus according to claim 1, wherein the grinding receptacle (6) and the grinding roller (10) are drivable to rotate in the same directions of rotation (41, 42).

3. The apparatus according to claim 1, wherein the grinding receptacle (6) and the grinding roller (10) are drivable to rotate by a common drive motor (2).

4. The apparatus according to claim 1, wherein at least one of the grinding receptacle (6) and the grading roller (10) are drivable to rotate by way of a gear (5).

5. The apparatus according to claim 4, wherein the gear (5) has an infinitely-variably-adjustable transmission.

6. The apparatus according to claim 1, wherein the width of the grinding gap (39) is 3 to 500 $\mu$m.

7. The apparatus according to claim 6, wherein the width of the grinding gap (39) is 5 to 50 $\mu$m.

8. The apparatus according to claim 1, wherein the width of the grinding gap (39) is adjustable.

9. The apparatus according to claim 8, wherein the width of the grinding gap (39) can be variably adjusted over its length b.

10. The apparatus according to claim 8, wherein at least one of the grinding receptacle (6) and the grinding roller (10) is seated on a bearing slide element (14) that is adjustable, relative to the stand (1), transversely to at least one of the axis of rotation (22) and the central longitudinal axis (16).

11. The apparatus according to claim 10, wherein the bearing slide element (14) is adjustable by at least one adjusting drive (21).

12. The apparatus according to claim 1, wherein the axis of rotation (22) and the central longitudinal axis (16) intersect at an angle a, to which the following applies: $0 \leqq a \leqq 45°$.

13. The apparatus according to claim 12, wherein the axis of rotation (22) and the central longitudinal axis (16) intersect at an angle a, to which the following applies: $10 \leqq a \leqq 30°$.

14. The apparatus according to claim 1, wherein the first grinding surface (33) is at least essentially frustoconical.

15. The apparatus according to claim 1, wherein the first grinding surface (33) is at least essentially cylindrical.

16. The apparatus according to claim 1, wherein the second grinding surface (34) is at least essentially cylindrical.

17. The apparatus according to claim 12, wherein the following applies to the diameter c of the second grinding surface (34) relative to the smallest diameter d of the first grinding surface (33): $c < d \times \cos a$.

18. The apparatus according to claim 17, wherein $0.2\ d \times \cos a \leqq c \leqq 0.9\ d \times \cos a$ applies.

19. The apparatus according to claim 9, wherein at least one of the grinding receptacle (6) and the grinding roller (10) is seated on a bearing slide element (14) that is adjustable, relative to the stand (1), transversely to at least one of the axis of rotation (22) and the central longitudinal axis (16).

* * * * *